US005583664A

United States Patent [19]

Sanpei

[11] Patent Number: 5,583,664

[45] Date of Patent: Dec. 10, 1996

[54] SHEET HOLDING MECHANISM FOR AN IMAGE FORMING APPARATUS

[75] Inventor: Takaaki Sanpei, Tokyo, Japan

[73] Assignee: NEC Corporation, Japan

[21] Appl. No.: 567,780

[22] Filed: Dec. 5, 1995

[30] Foreign Application Priority Data

Dec. 8, 1994 [JP] Japan ..... 6-304940

[51] Int. Cl.[6] ..... H04N 1/04; B65H 31/26; B65H 31/00

[52] U.S. Cl. ..... 358/498; 358/492; 271/220; 271/207; 271/902

[58] Field of Search ..... 358/498–492, 358/496; 271/220, 207, 902

[56] References Cited

FOREIGN PATENT DOCUMENTS 62-93168 4/1987 Japan .

*Primary Examiner*—Edward L. Coles, Sr.
*Assistant Examiner*—Tia M. Harris
*Attorney, Agent, or Firm*—Ostrolenk, Faber, Gerb & Soffen, LLP

[57] ABSTRACT

In an image forming apparatus, a sheet holding mechanism has an outlet roller and a presser member cooperative to nip a sheet having a unit length and undergone predetermined processing in the apparatus. When the outlet roller is rotated, it drives the sheet out of the apparatus in cooperation with the presser member. When the sheet reaches a position where its leading edge portion protrudes from the apparatus and its trailing edge portion is brought to a predetermined position between the outlet roller and a holder member, the outlet roller is reversed to insert the trailing edge into a nipping portion included in the holder member. The holder member holds the trailing edge of the sheet. As a result, the sheet is retained in the apparatus with its leading edge portion protruding from the apparatus. A force for pulling out the sheet from the holder member is greater than the conveying force of the outlet roller. Hence, the next sheet carrying data thereon is conveyed toward the outside of the apparatus by being nipped between the first sheet and the outlet roller. When the trailing edge of the second sheet arrives at the predetermined position, the outlet roller is reversed. Because the conveying force of the outlet roller is greater than a force for inserting the sheet into the holder member, the trailing edge of the second sheet is inserted into the nipping portion and held thereby while underlying the first sheet. The mechanism makes it needless to mount a so-called stacker on the apparatus.

5 Claims, 6 Drawing Sheets

SHEET HOLDING MECHANISM FOR AN IMAGE FORMING APPARATUS

BACKGROUND OF THE INVENTION

The present invention relates to a facsimile apparatus, printer, copier or similar image forming apparatus and, more particularly, to a sheet holding mechanism for such an apparatus and capable of eliminating the need for a so-called stacker protruding from the apparatus for stacking sheets driven out of the apparatus.

A facsimile apparatus, for example, usually has a flat stacker protruding therefrom in order to stack sheets or recordings thereon. The problem with the stacker is that it protrudes from the apparatus to a substantial distance and thereby increases the overall space to be allocated to the apparatus. In order to obviate this problem, Japanese Patent Laid-Open Publication No. 62-93168, for example, proposes a sheet holding mechanism built in a facsimile apparatus and replacing the above stacker. The mechanism holds cut sheets sequentially produced in the apparatus and allows the operator to take them out, as needed. This saves space for the installation of the facsimile apparatus. However, the above mechanism is complicated in construction and increases the number of constituent parts. An increase in the number of parts lowers reliability and results in an increase in size and cost.

SUMMARY OF THE INVENTION

It is, therefore, an object of the present invention to provide a sheet holding mechanism simple construction and practicable with a minimum number of enhancing the reliable operation of an image forming apparatus on which the mechanism is mounted.

It is another object of the present invention to provide a sheet holding mechanism which does not increase the size or the production cost of an image forming apparatus on which it is mounted.

In accordance with the present invention, a mechanism for holding, in an appratus on which the mechanism is mounted, at least one sheet having a unit length and undergone predetermined processing in such a position that the leading edge portion of the sheet protrudes from the apparatus has an outlet roller for causing the leading edge portion of the sheet to protrude from the apparatus. A presser member presses the sheet against the outlet roller. A holder member is positioned upstream of the outlet roller in the intended direction of sheet discharge, and has a nipping portion which is open toward the outlet roller. The nipping portion holds the sheet inserted into the holder member at the open side of the nipping portion. The outlet roller is reversed, when the trailing edge portion of the sheet is brought to a predetermined position between the outlet roller and the holder member, to thereby insert the trailing edge portion of the sheet into the nipping portion.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, a brief reference will be made to a conventional sheet holding mechanism, shown in FIG. 1. The mechanism to be described is of the kind built in the receiving section of a facsimile apparatus by way of example and eliminating the need for a stacker, as taught in previously mentioned Japanese Patent Laid-Open Publication No. 62-93168.

Figure 1:
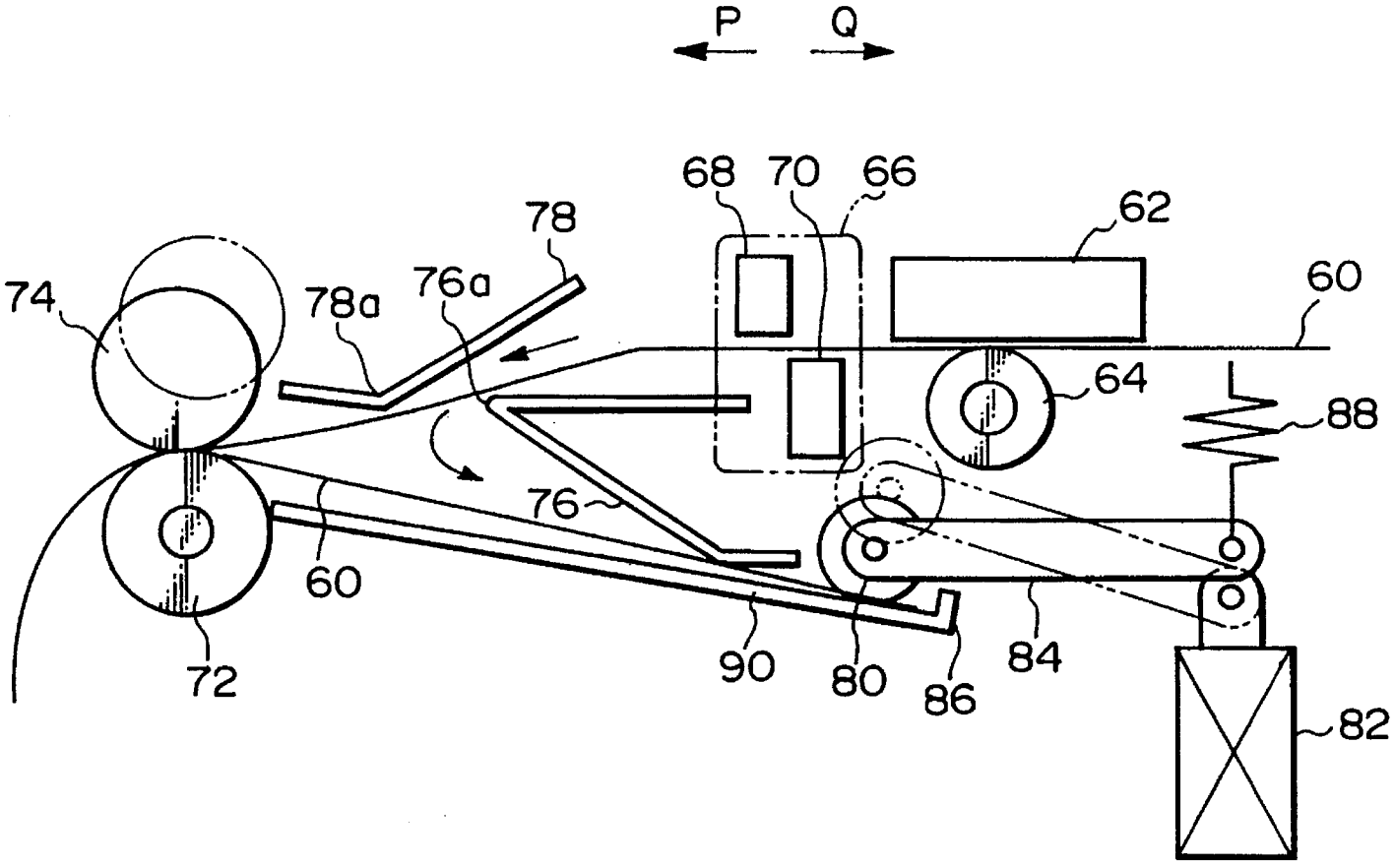
Fig. 1 PRIOR ART
FIG. 1 is a section showing the general construction of a conventional sheet holding mechanism included in an image forming apparatus.

As shown in FIG. 1, a platen roller 64 is pressed against a thermal head 62 in order to define a sheet transport path. A webbing 60 is a thermosensitive recording medium which blackens when heated. When the roller 64 is rotated, it conveys the webbing 60 in a direction indicated by an arrow P in cooperation with the head 62. A cutter 66 for cutting the webbing 60 is made up of an upper edge 68 and a lower edge 70. The webbing 60 is passed through between the edges 68 and 70 to a nip between an outlet roller 72 and an auxiliary roller 74 facing the roller 72. The rollers 72 and 74 cooperate to convey the webbing 60 further in the direction P. After a series of data have been fully recorded on the webbing 60 by the head 62, the position of the webbing 60 where the recording has ended is brought to the cutter 66. Then, the cutter 66 cuts the webbing 60 in a predetermined size with the edges 68 and 70 under the control of a control circuit, not shown. The cut length of the webbing, i.e., a sheet 60 is conveyed along a guide 76 in the direction P to a position where its trailing edge is clear of a bend **76*a* included in the guide 76, but short of the outlet roller 72**.

Subsequently, the outlet roller 72 and auxiliary roller 74 are reversed to convey the sheet 60 in a direction indicated by an arrow Q in the figure. As a result, the trailing edge of the sheet 60 in the direction P, i.e., the leading edge in the direction Q hangs down due to its own weight or by being urged downward by a bend **78*a* included in a guide 78. Hence, the sheet 60 is transferred from the path above the guide 76 to the path below the guide 76, as indicated by an arrow in the figure. When the leading edge of sheet 60 in the direction Q approaches a press roller 80, a solenoid 82 is energized by the control circuit. The solenoid 82 moves a lever 84 connected thereto to a position indicated by a dash-and-dots line in the figure, thereby unblocking a path for the incoming sheet 60. When the sheet 60 abuts against a stop 86, the drive of the outlet roller 72 is interrupted while the solenoid 82 is deenergized. Consequently, the press roller 80 is brought to a position indicated by a solid line by a spring 88, thereby pressing the trailing edge of the sheet 60 against a guide 90. Thereafter, when the leading edge of the webbing 60 is conveyed to the cooperative rollers 72 and 74, the roller 74 is raised to a position indicated by a dash-and-dots line. When the webbing 60 is to be cut to separate the next sheet, the roller 74 is lowered to a position indicated by a solid line. Then, the above procedure is repeated to cause the press roller 80 to press the next sheet against the guide 90**. The resulting sheet stack will be taken out by an operator later.

The conventional mechanism described above is complicated in construction, and impractical without increasing the number of constituent parts, as discussed earlier. An increase in the number of parts not only lowers reliability, but also increases the overall size and cost of the apparatus.

Figure 2:
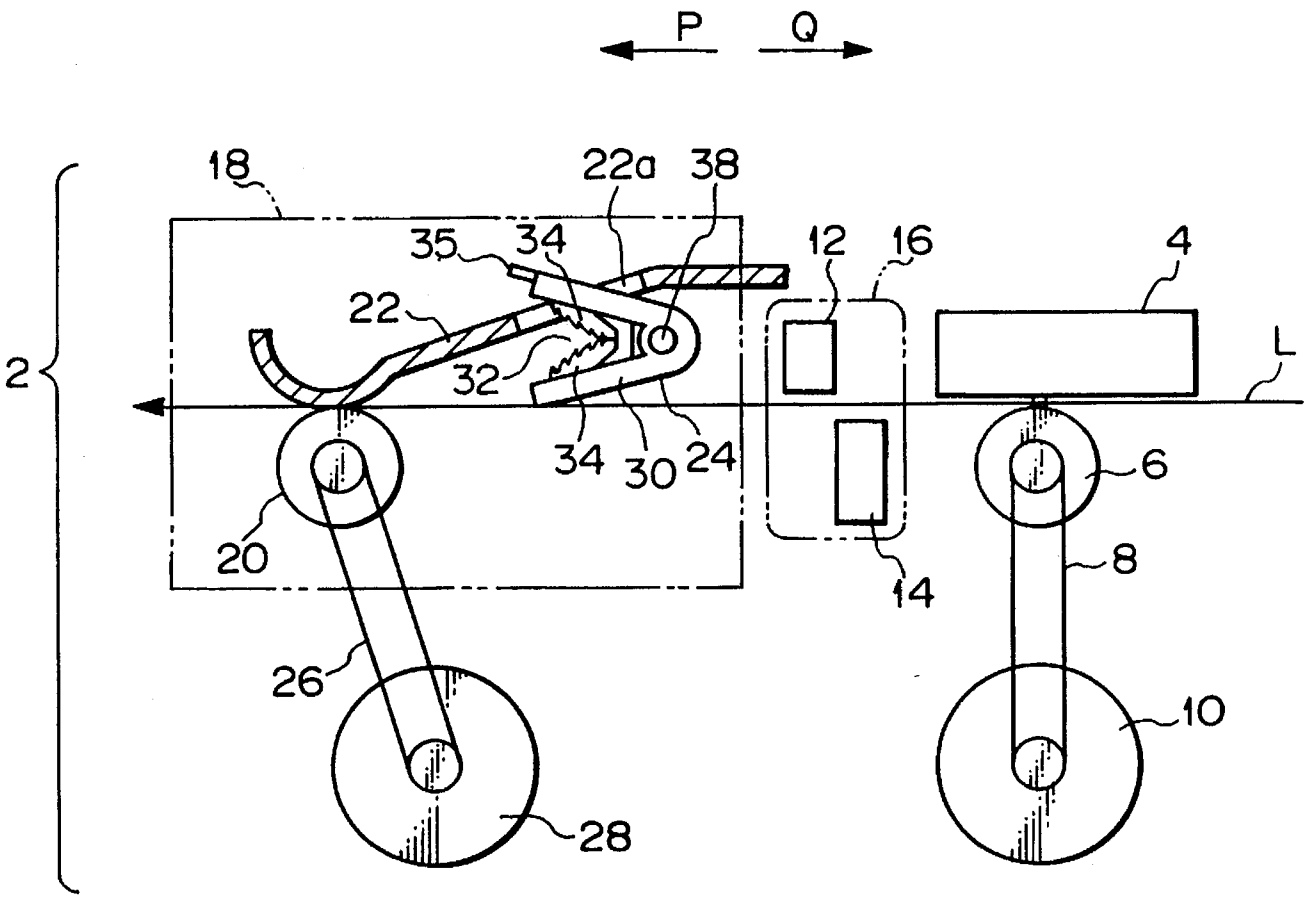
FIG. 2 is a section showing the general construction of a sheet holding mechanism embodying the present invention.

Referring to FIG. 2 of the drawings, a sheet holding mechanism embodying the present invention is shown and built in a facsimile apparatus 2 by way of example. As shown, the apparatus 2 has a thermal head 4 for generating heat on a line in response to a record signal, a platen roller 6 pressed against the head 4 on the above line, a motor 10 for driving the roller 6 via a belt 8, a cutter 16 having an upper edge 12 and a lower edge 14, and a sheet holding mechanism 18 embodying the present invention. Labeled L in the figure is a sheet transport path.

Figure 3:
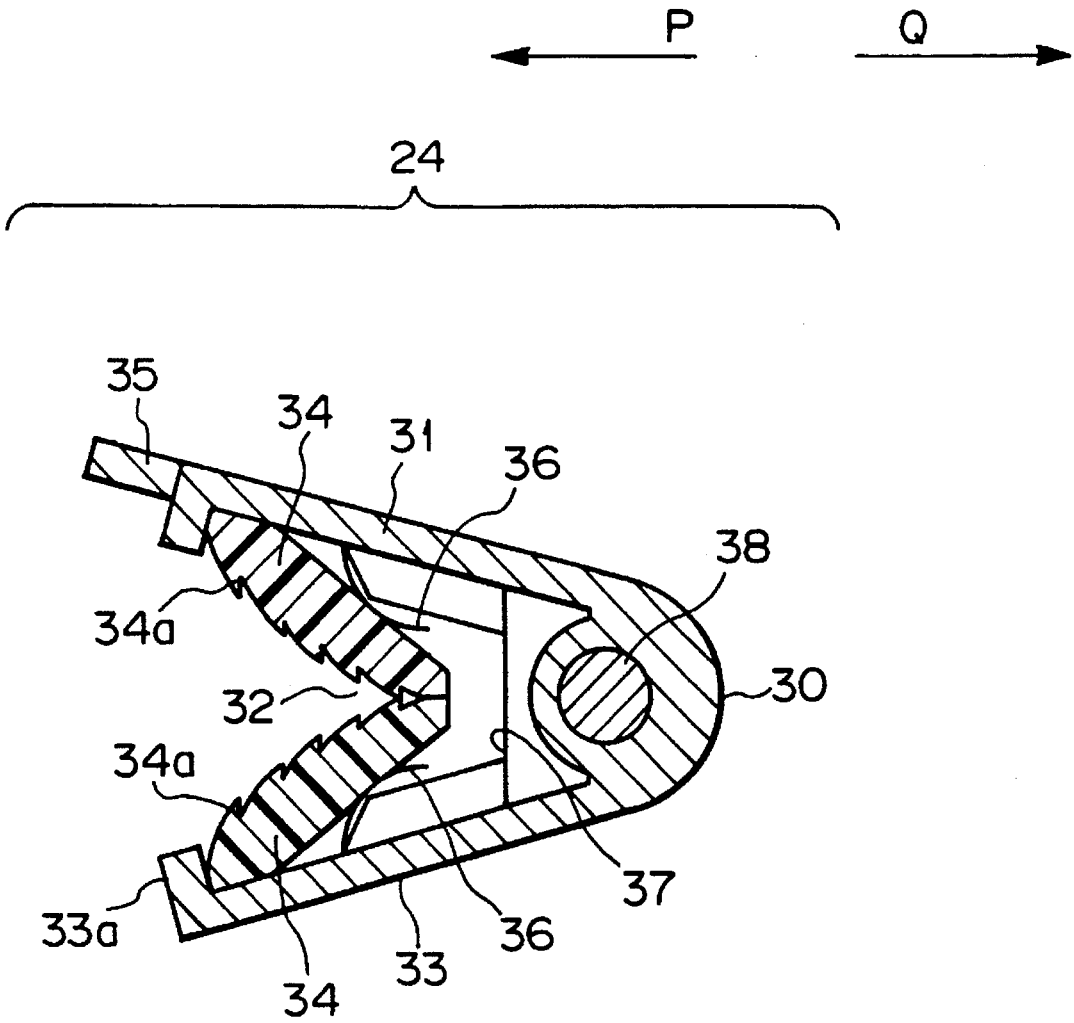
FIG. 3 is a section showing a specific configuration of a holder member included in the embodiment.

The sheet holding mechanism 18 has an elastic outlet roller 20 made of rubber, a presser member 22 pressed against the roller 20, and a holder member 24 located on the transport path L upstream of the roller 20 in a direction P (or downstream in a direction Q). A motor 28 drives the roller 20 via a belt 26. As shown in FIG. 3, the holder 24 is made up of a generally V-shaped body 30 which is open at the roller 20 side, and a nipping portion 32 disposed in the body 30. The nipping portion 32 is implemented by a pair of friction pieces 34 arranged in the form of a letter V such that the gap therebetween sequentially decreases in the direction Q. The body 30 has an upper guide 31 and a lower guide 33.

The friction pieces 34 are made of rubber and formed with teeth 34*a* on their facing surfaces. The teeth 34*a* are inclined in the direction Q. Each friction piece 34 is constantly urged by a leaf spring 36 on the rear thereof, so that the piece 34 can preserve its nipping function over a long period of time. The V-shaped body 30 is rotatably supported by a pin 38 at the bottom of "V", as illustrated. In this condition, the body 30 is rotatable over an angular range of about 15 degrees. The downward rotation of the body 30 about the pin 38 is limited when a stop 35 formed at the end of the upper guide 31 abuts against the edge of an opening 22*a* (see FIG. 2) formed in the presser 22. Hence, by forming the opening 22*a* in a suitable position, it is possible to set the gap or opening of the holder 24 adequately in in accordance with, e.g., the degree of flexibility of sheets. In FIG. 3, the reference numeral 37 designates the rear end face of the body 30.

In the illustrative embodiment, one holder 24 is located at each of opposite sides of the center of the sheet transport path, and is about 3 cm wide as measured in the direction 10 perpendicular to the sheet transport direction. Of course, three or more holders 24 may be used, if desired. The distance between the platen roller 6 and the cutting position of the cutter 16 is about 30 mm. The distance between the cutting position and the outlet roller 20 is 50 mm. The lower guide 33 of the body 30 is about 30 mm long.

Figure 4:
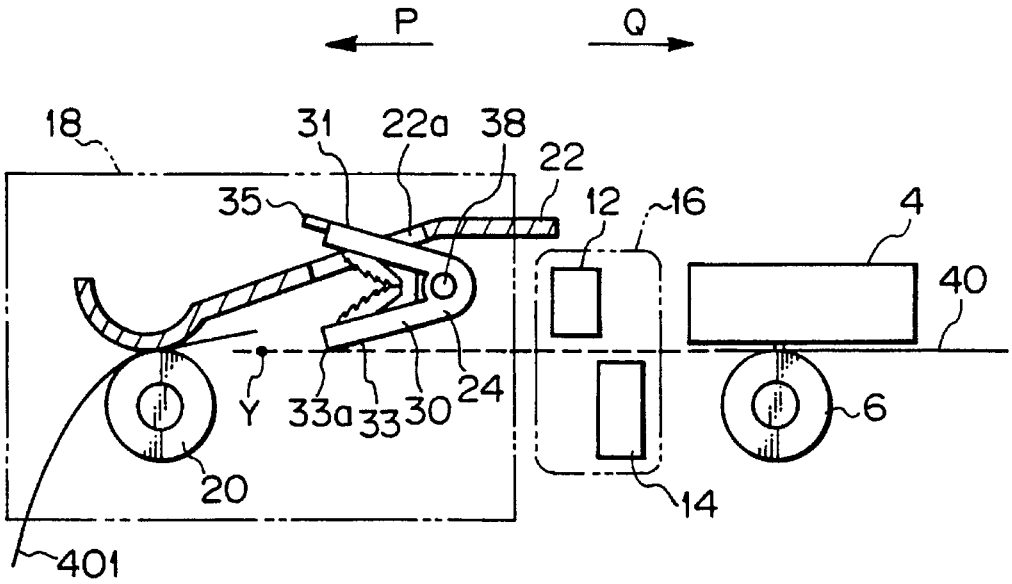
FIG. 4 is a section showing the holder member not holding a sheet.
Figure 5:
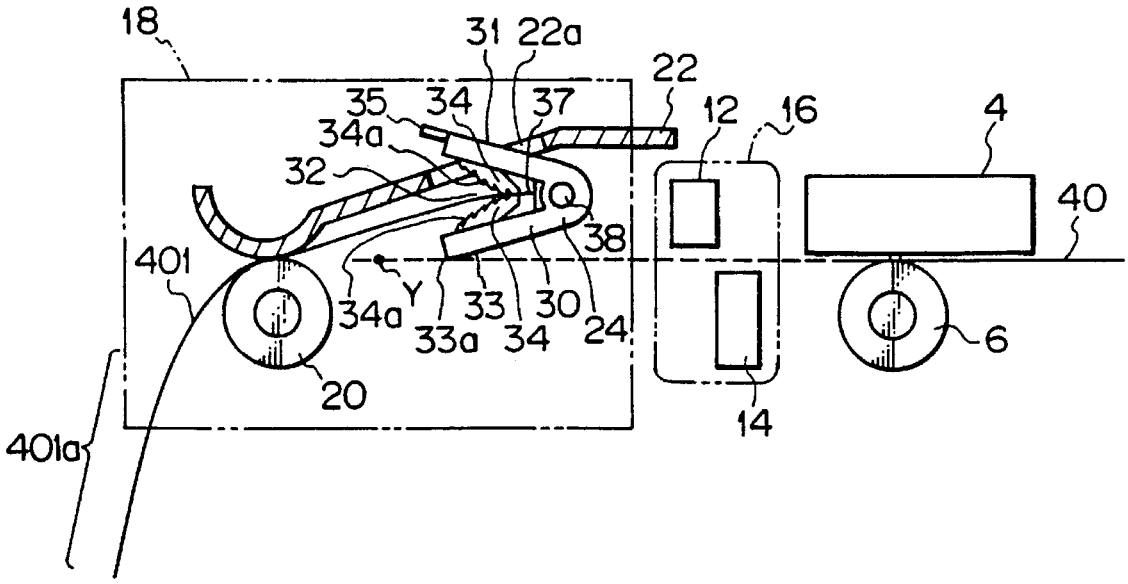
FIG. 5 is a section showing the holder member holding a sheet.

A reference will be made to FIGS. 4 and 5 for describing the operation of the sheet holding mechanism 18. The platen roller 6 and outlet roller 20 are each rotated at a particular speed such that the latter 20 conveys a webbing 40 about 10% faster than the former 6. This prevents the webbing 40 from slackening between the rollers 6 and 30. The ratio of the conveying force of the platen roller 6 to that of the outlet roller 20 is selected to be about 10:1. Hence, when the rollers 6 and 20 convey the webbing at the same time, the roller 6 conveys it while the roller 20 simply slips on it.

After a series of data has been recorded on the webbing 40, the webbing 40 is fed forward at a high speed about 30 mm away from the printing position (direction P) and then cut by the cutter 16. Subsequently, the platen roller 6 i s reversed to convey the webbing 40 backward about 25 mm in the direction Q; otherwise, the blank portion of the webbing 40 between the leading edge and the cutting position would be simply wasted. On the other hand, a sheet 401 cut away from the webbing 40 is conveyed by the outlet roller 20 by a predetermined amount. When the motor 28 is implemented as a stepping motor, the above predetermined amount will be indicated by a control circuit, not shown, in terms of the number of steps. By such a predetermined amount of conveyance, the sheet 401 is brought to a position where its trailing edge in the direction P arrives at a preselected position Y between the roller 20 and the end 33*a* of the holder 24. Specifically, the trailing edge of the sheet 401 conveyed along the lower guide 33 in the direction P. As shown in FIG. 4, on moving away from the end 33*a* of the lower guide 33, the trailing edge of the sheet 401 springs up about the point where the roller 20 and presser 22 contact each other. As a result, the trailing edge contacts or almost contacts the presser 22.

When the trailing edge of the sheet 401 arrives at the position Y, the motor 28 is reversed by the control circuit so as to convey the trailing edge toward the open end of the holder 24 in the direction Q. As shown in FIG. 5, the trailing edge of the sheet 401 is inserted into the holder 24 while sequentially laying the teeth 34*a* of the friction pieces 34. The sheet 401 is brought to a stop when its trailing edge is about to contact the rear end face 37 of the body 30, as determined in terms of the number of steps of the motor 28.

The above procedure constitutes a single cycle and ends if the next recording is absent. As shown in FIG. 5, the sheet 401 is held by the holder 24 and the cooperative roller 20 and presser 22. In this condition, a part 401*a* of the sheet 401 (about 25 cm in the case of size A4 as prescribed by JIS (Japanese Industrial Standards)) protrudes from t h e apparatus. A person intending to take out the sheet 401 will hold the portion 401*a* of the sheet 401.

Figure 6:
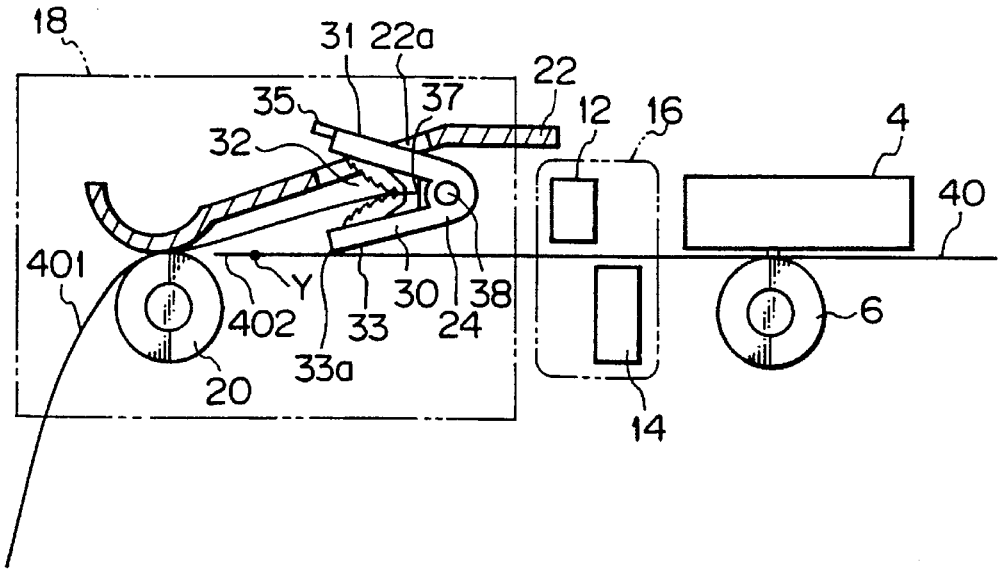
FIG. 6 is a section demonstrating how a second recorded portion of a webbing is conveyed in the embodiment.
Figure 7:
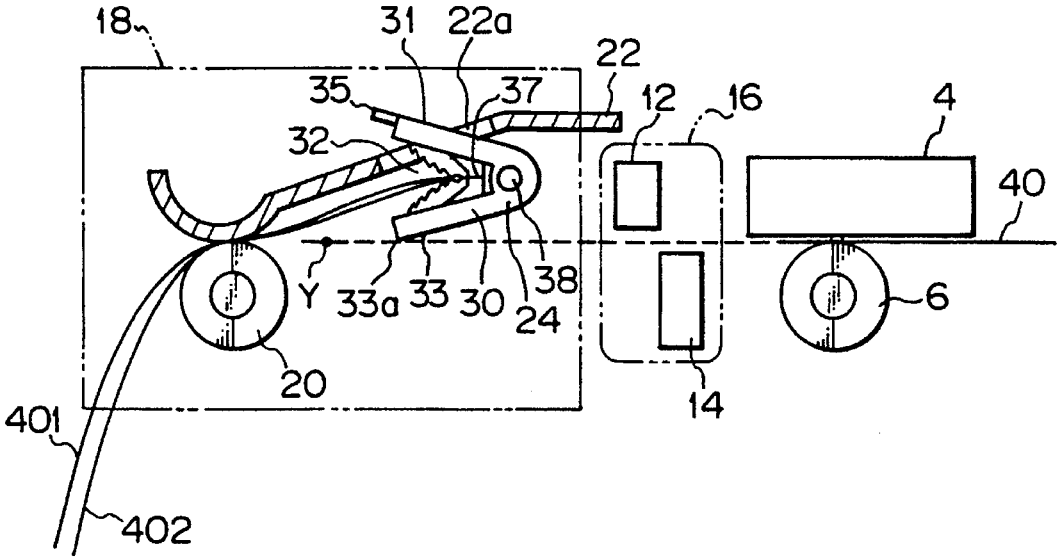
FIG. 7 is a section demonstrating how a second sheet cut away from the webbing is held in the embodiment.

Assume that the friction acting between the sheet 401 and the presser 22 is A, that the friction acting between the sheet 401 and the roller 20 is B, that the friction acting between the sheet 401 being inserted into the holder 24 and the holder 24 is C, and that the friction acting between the sheet 401 being pulled out of the holder 24 and the holder is D. Then, in order to cause the mechanism 18 to perform the above operation, the following relation should be satisfied: $A \leqq C < B < D$ Referring to FIGS. 6 and 7, how the mechanism 18 operates when two or more sheets are sequentially cut away from the webbing 40. When the second recording begins, the platen roller 6 and outlet roller 20 are rotated in the forward direction. At this instant, the first sheet 401 remains in the holder 24 because the retaining force of the holder 24 is greater than the conveying force of the roller 20. The leading edge of the webbing 40 carrying the second series of data is brought into contact with the sheet 401 and conveyed by the roller 20. Then, the webbing 40 is cut by the cutter 16 to separate a second sheet 402. As shown in FIG. 7, when the trailing edge of the sheet 402 is conveyed to the position Y by the motor 28, the roller 20 is reversed to insert the trailing edge of the sheet 402 into the nipping portion 32 of the holder 24.

Figure 8:
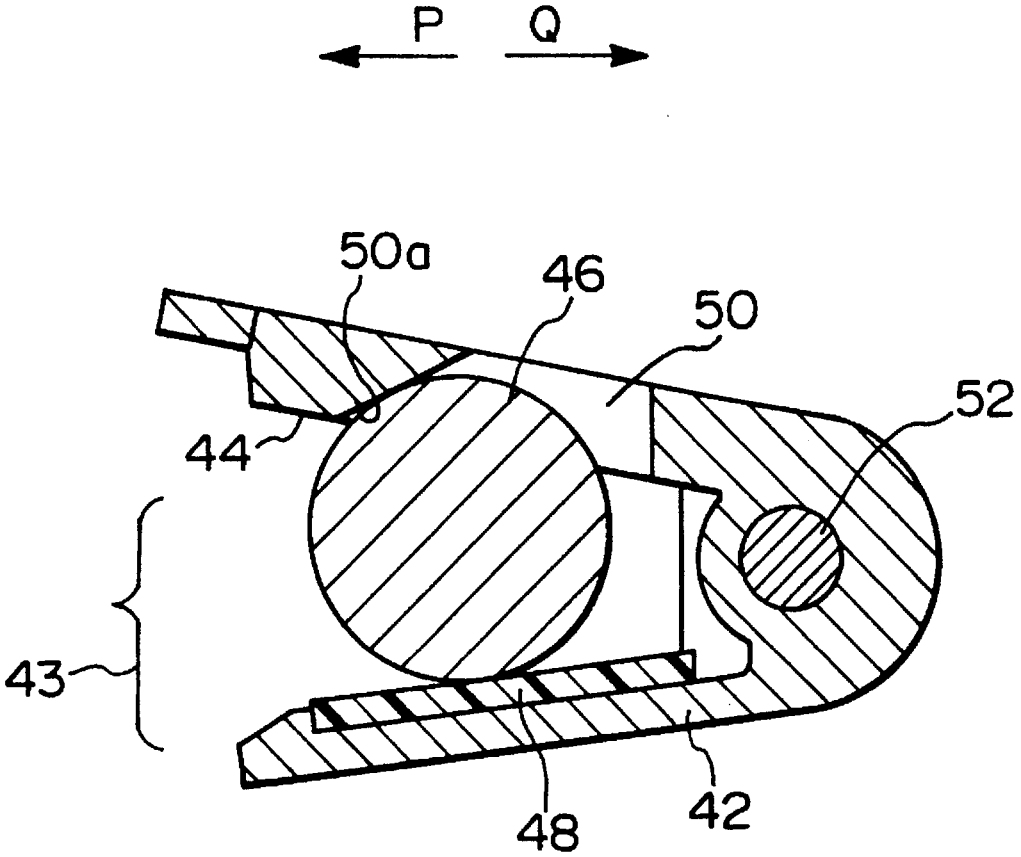
FIG. 8 is section showing another specific configuration of the holder member.

FIG. 8 shows another specific configuration of the sheet holder 24. As shown, the holder, labeled 42, has a nipping portion 43 implemented by a generally V-shaped recess 44 and a spherical member or ball 46 made of metal. Although the ball 46 is not separable from the recess 44, it is rollable in the direction Q. A rubber member 48 is fitted on the bottom of the recess 44 while an opening 50 is formed in the top of the recess 44. The ball 46 rests on the rubber member 48 due to its own weight and rolls while being partly received in the opening 50. The reference numeral 52 designates a pin about which the holder 42 rotatable over a predetermined range.

The opening 50 has a front edge 50*a* which is inclined toward the outlet roller 50. Hence, when the cut sheet is inserted into the holder 42 in the direction Q, the ball 46 also rolls or moves in the direction Q and thereby lightly nips the sheet. Conversely, when the sheet is pulled in the direction P, the ball 46 rolls or moves in the direction P into a wedge portion defined by the edge 50*a* of the opening 50 and the rubber member 48. As a result, the ball 46 strongly urges the sheet against the rubber member 48, thereby holding the sheet in the apparatus.

While the embodiment has been shown and described in relation to a facsimile apparatus, it is similarly applicable to any other image forming apparatus, e.g., a copier or a printer. In addition, the embodiment is practicable not only with recording sheets but also with documents.

In summary, it will be seen that the present invention provides a sheet holding mechanism capable of holding sheets with a simple configuration and without resorting to changes in a sheet transport path. In addition, the mechanism needs a minimum number of parts for control. This successfully reduces the size and cost of an image forming apparatus on which the mechanism is mounted, while enhancing the reliable operation of the apparatus.

Various modifications will become possible for those skilled in the art after receiving the teachings of the present disclosure without departing from the scope thereof.

What is claimed is:

1. A mechanism for holding, in an apparatus on which said mechanism is mounted, at least one sheet having a unit length and having undergone predetermined processing in such a position that a leading edge portion of the sheet protrudes from said apparatus, said mechanism comprising:

an outlet roller for causing the leading edge portion of the sheet to protrude from said apparatus;

a presser member for pressing the sheet against said outlet roller;

a holder member positioned upstream of said outlet roller in an intended direction of sheet discharge, and having a nipping portion which is open toward said outlet roller;

said nipping portion holding the sheet inserted into said holder member at an open side of said nipping portion;

said outlet roller being reversed when a trailing edge portion of the sheet is brought to a predetermined position between said outlet roller and said holder member to thereby insert the trailing edge portion of the sheet into said nipping portion.

2. A mechanism as claimed in claim 1, wherein said nipping portion comprises a pair of friction members arranged in a form of a letter V such that a distance between said pair of friction members sequentially decreases from a downstream side to an upstream side in the intended direction of sheet discharge.

3. A mechanism as claimed in claim 1, wherein said nipping portion comprises a generally V-shaped recess, and a spherical member movably received in said recess.

4. A mechanism as claimed in claim 1, wherein said holder member is rotatably supported at an upstream end thereof in the intended direction of sheet discharge.

5. A mechanism as claimed in claim 1, wherein a force for pulling out the sheet from said holder member is selected to be greater than a sheet conveying force of said outlet roller, and wherein said sheet conveying force of said outlet roller is selected to be greater than a force for inserting the sheet into said holder member.

* * * * *